United States Patent [19]

Williams

[11] 3,955,331

[45] May 11, 1976

[54] RETAINING SYSTEM FOR ARCHITECTURAL GLAZING STRIP

[75] Inventor: Fred Williams, Pittsford, N.Y.

[73] Assignee: Schlegel Corporation, Rochester, N.Y.

[22] Filed: Sept. 3, 1974

[21] Appl. No.: 502,795

[52] U.S. Cl. ..... 52/397; 52/502

[51] Int. Cl.[2] ..... E06B 3/62

[58] Field of Search ..... 52/397–401, 52/501, 502

[56] References Cited

UNITED STATES PATENTS

| | | | |
|---|---|---|---|
| 973,547 | 10/1910 | Newpher | 52/400 |
| 2,205,538 | 6/1940 | Owen | 52/397 |
| 2,342,352 | 2/1944 | Lowry | 52/502 |
| 2,767,814 | 10/1956 | Johnson | 52/401 |
| 3,024,881 | 3/1962 | Haas | 52/501 X |
| 3,478,997 | 11/1969 | Goss | 52/397 X |
| 3,501,884 | 3/1970 | DiCesare, Jr. et al. | 52/397 |

FOREIGN PATENTS OR APPLICATIONS

| | | | |
|---|---|---|---|
| 1,456,933 | 9/1966 | France | 52/397 |

*Primary Examiner*—Alfred C. Perham
*Attorney, Agent, or Firm*—George W. Shaw

[57] ABSTRACT

The retaining system is for an architectural glazing strip having spring material encased in an elastomer to extend from an anchorage edge of the strip to a glass-engaging edge of the strip. It includes anchorage means for securing the anchorage edge of the strip in place around the periphery of a glass panel so the glass-engaging edge of the strip is cantilevered outward for pressing against the glass panel. A length of a retainer strip that is generally wedge shaped in cross section is driven into a recess in the anhcorage extending along the anchorage edge of the glazing strip opposite the glass panel so that the wedge-shaped strip supports the glazing strip in an installed position with the glass-engaging edge pressing against the glass panel with a predetermined force. Interference means between the recess and the wedge-shaped strip retains the wedge-shaped strip in place.

3 Claims, 5 Drawing Figures

RETAINING SYSTEM FOR ARCHITECTURAL GLAZING STRIP

THE INVENTIVE IMPROVEMENT

A preferred glazing strip for holding glass panels in place in buildings uses a spring material encased in an elastomer so that when the strip is anchored in place, the spring material provides the resilient force for pressing a cantilevered edge of the strip against the window glass. Often, such strips are mounted on each side of the glass panel, and to achieve the desired pressure for the seal, the spring elements must be deformed from a relaxed position. This makes installation of the final glazing strip fairly difficult, because a strip or seal on the opposite side of the glass must be deformed, the glass moved slightly, and the final strip being installed must also be flexed, all of which requires considerable force.

The invention involves recognition of a simple and easy way to install such glazing strips to secure the desired deformation and spring pressure against the glass while using minimum materials and equipment. The invention aims at convenience, simplicity, economy, practical effectiveness, and reliability in a glazing strip installation.

SUMMARY OF THE INVENTION

The inventive retaining system is for an architectural glazing strip having a longitudinally extending spring material encased in an elastomeric material to extend laterally from the an anchorage edge region of the strip to a glass-engaging edge region of the strip. An anchorage means secures the anchorage region of the strip in place around the periphery of a glass panel so the glass-engaging edge is cantilevered outward for pressing against the glass panel. The anchorage means includes a recess extending along the anchorage edge region of the strip on the side of the glazing strip opposite the glass panel, and a length of retainer strip that is generally wedge shaped in cross section is driven into the recess to support the anchorage edge of the glazing strip in an installed position so the glass-engaging edge presses against the glass panel with a predetermined force. Interference means between the recess and the wedge-shaped strip retains the wedge-shaped strip in the recess. The invention also includes the method of installing the glazing strip using a wedge-shaped retainer strip.

DRAWINGS

DETAILED DESCRIPTION

Figure 1:
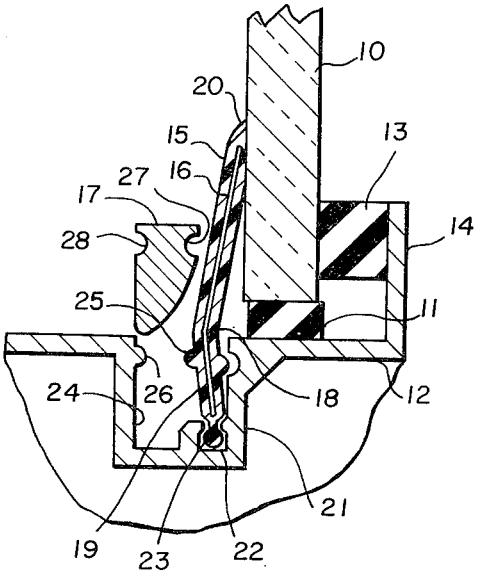
FIG. 1 is a partially schematic, fragmentary cross-sectional view of a preferred embodiment of the inventive retaining system partially assembled to hold a glass panel.
Figure 2:
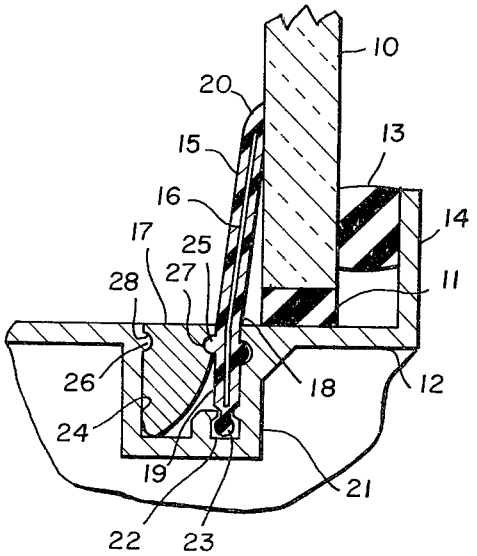
FIG. 2 shows the view of FIG. 1 in fully assembled relation.

The embodiment of FIGS. 1 and 2 shows a window glass 10 supported on a setting block 11 in a frame 12 to be positioned against a compressible gasket or seal 13 supported on an inturned edge 14 of frame 12. The pressure for the seal is provided by a glazing strip 15 having an internal spring element 16. Strip 15 is loosely assembled against glass 10 in FIG. 1, and is fully installed and held in final position by a wedge-shaped retainer strip 17 as shown in FIG. 2.

Sping material 16 in glazing strip 15 extends longitudinally of strip 15 and is preferably formed of a zig-zag wire element formed in a pattern of transverse zig-zag loops secured together by longitudinally extending knitted strands (not shown). Spring element 16 can have many cross-sectonal shapes depending upon the configuration of each particular installation, and spring element 16 is preferably encased in an elastomeric material 18 that is preferably extruded to completely cover spring element 16. Elastomeric material 18 protects spring element 16 and provides a good frictional seal against glass panel 10.

Glazing strip 15 has an anchorage edge region 19 to be fitted into an anchorage around the periphery of glass panel 10, and the opposite edge 20 of glazing strip 15 is cantilevered outward for engagement with glass 10. Spring material 16 has the proper resilient characteristics to press edge 20 firmly against glass 10 with a predetermined force per linear inch of preferably at least 4 pounds per linear inch.

Frame 12 includes an anchorage channel 21 having a recess 22 for receiving the edge 23 of strip 15. Channel 21 also includes a recess 24 extending along the anchorage edge region 19 of strip 15 on the opposite side of glass panel 10. Wedge-shaped retainer strip 17 is shaped relative to recess 24 and glazing strip 15 to be driven into recess 24 to the position shown in FIG. 2 to support glazing strip 15 in a fully installed position with edge 22 pressing tightly and firmly against glass 10. Detent 25 on glazing strip 15 and opposite detent 26 in channel 21 cooperate with corresponding detents 27 and 28 on opposite sides of retainer strip 17 for an interference fit preventing retainer strip 17 from coming loose from channel 21.

When glass panel 10 is first installed against gasket 13, pressure is required to move glass panel 10 against gasket 13 for a tight compressive seal. Also, spring material 16 of glazing strip 15 has to be deformed from a relaxed position to apply the desired pressure of sealing edge 20 against glass 10. When glazing strip 15 is first mounted in channel 21 it assumes the position shown in FIG. 1, and retainer strip 17 provides the considerable force that is required to press anchorage region 19 of strip 15 tightly into channel 21 and flex the cantilevered end of strip 15 into the desired forceful engagement with glass panel 10. Strip 17 is preferably formed of a relatively hard elastomeric or resin material so that it can be driven forcefully into recess 24 to apply such pressure to glazing strip 15. The result economizes on material and allows glazing strip 15 to have a relatively thin elastomeric coating 18 over the proper spring material 16, and the flat top of retainer strip 17 is used for pounding or engagement by a roller tool for forcing the assembly into the final installation position of FIG. 2. The assembly is then simple and convenient, and can be done without error by relatively unskilled workers at the building site.

Figure 3:
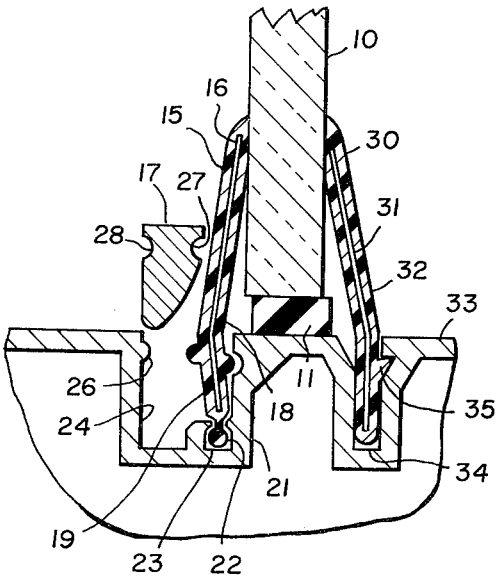
FIG. 3 is a partially schematic, fragmentary cross-sectional view of another preferred embodiment of the inventive retaining system in partially assembled relation.
Figure 4:
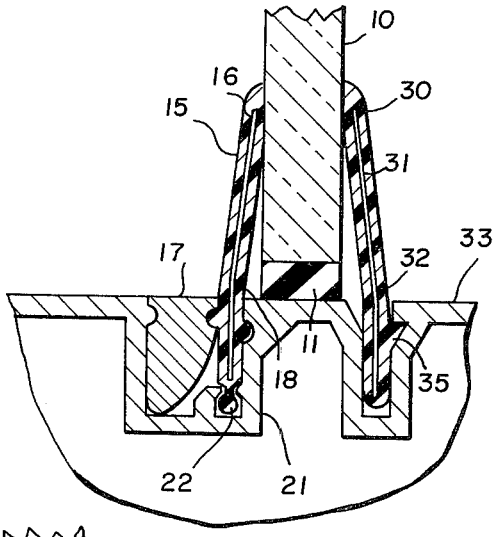
FIG. 4 shows the view of FIG. 3 in fully assembled relation.

FIGS. 3 and 4 show another preferred embodiment of the inventive retaining system similar to the embodiment of FIGS. 1 and 2, except for using a pair of glazing strips. Glazing strip 15 and retainer strip 17 are similar and work in the same way, but instead of compressive seal 13 on the opposite side of glass 10, another glazing strip 30 having a spring material 31 encased in an elastomer 32 is mounted in a retainer slot 34 in frame 33 on the opposite side of glass panel 10 from glazing strip 15. An interference detent 35 secures glazing strip 30 in recess 34, and then glass 10 is positioned against glazing strip 30 as shown in FIG. 3. Driving wedge-shaped retainer strip 17 into recess 24 moves glass 10 to a central position between glazing strips 15 and 30, and deforms springs 16 and 31 so that both glazing strips 15 and 30 press against opposite faces of glass 10 with the desired forceful pressure.

Figure 5:
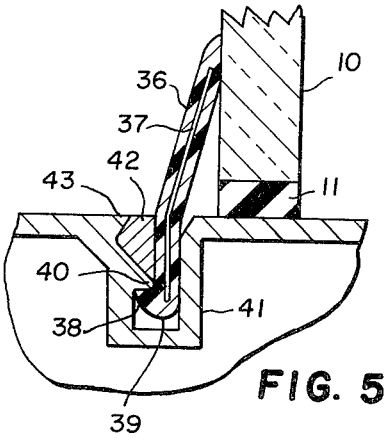
FIG. 5 is a partially schematic, fragmentary cross-sectional view of another preferred embodiment of the inventive retaining system in assembled relation.

FIG. 5 illustrates that other cross-sectional shapes and retainer strips having different shapes are possible in practicing the invention. Glazing strip 36 with its interior spring 37 has an interfering projection 38 near its anchorage edge 39 for interlocking with a projection 40 in retainer channel 41, and wedge-shaped strip 42 is shaped to be driven into the upper portion of retainer channel 21 for an interference fit under edge 43 to accomplish the function of retainer strip 17 of FIGS. 1–4. Many other shapes of wedge-shaped retainer strips, detent means, and interlocks between the anchorage edges of glazing strips and the frame around a window glass are also possible. Furthermore, a pair of glazing strips can interlock with each other around the periphery of a window glass, and a wedge-shaped strip can be driven into a recess adjacent one or both of the glazing strips to apply the final pressure desired for holding the glass securely in place and providing a leak-proof seal.

In addition to the many configurations possible in practicing the invention, different materials can be used, and configurations can be adapted to the particular materials selected. Channels or anchorages can be made in many ways between glazing strips and frames or between interlocking pairs of glazing strips, and recesses for receiving retainer strips can also be formed in many ways. Frames can be made of extruded aluminum or cast concrete containing reglets, or even can be formed of wood, and those skilled in the art will know how to shape the components and make them out of the proper materials for any particular installation once they know the basic concepts of the invention.

I claim:

1. A retaining system for an architectural glazing strip having a longitudinally extending spring material encased in an elastomeric material to extend laterally from an anchorage edge region of said strip to a glass-engaging edge region of said strip, said retaining system comprising:

a. anchorage means for securing said anchorage edge region in place around the periphery of a glass panel so said glass-engaging edge region is cantilevered outward from said anchorage means for pressing against said glass panel;

b. a length of a retainer strip generally wedge-shaped in cross section;

c. said anchorage means including a recess extending along said anchorage edge region on the side of said glazing strip opposite said glass panel;

d. said wedge-shaped strip being configured relative to said recess and said glazing strip so said wedge-shaped strip can be driven into said recess to support said anchorage edge region in an installed position so said glass-engaging edge region presses against said glass panel with a predetermined force;

e. a first interference means between said recess and said anchorage edge region of said glazing strip;

f. a second interference means between said recess and said wedge-shaped strip for retaining said wedge-shaped strip in said recess; and g. said second interference means including detent means on said recess and on said anchorage edge region, and corresponding detent means on each side of said wedge-shaped strip.

2. The system of claim 1 including another one of said glazing strips, and means for mounting said other glazing strip to engage the side of said glass panel opposite the side engaged by said first-mentioned glazing strip.

3. The system of claim 1 including a compressible gasket and means for mounting said gasket to engage the side of said glass panel opposite the side engaged by said glazing strip.

* * * * *